US005894991A

United States Patent [19]

Edwards et al.

[11] Patent Number: 5,894,991

[45] Date of Patent: Apr. 20, 1999

[54] UNIT INJECTOR WITH HARD STOP TIMING PLUNGER

[75] Inventors: Steven D. Edwards; Dan K. Vetters, both of Columbus; Dan K. Hickey, Greenwood; George L. Muntean; Ray J. Amlung, both of Columbus; Jeffrey L. Campbell, Hope, all of Ind.

[73] Assignee: Cummins Engine Company, Inc., Columbus, Ind.

[21] Appl. No.: 08/916,267

[22] Filed: Aug. 22, 1997

[51] Int. Cl.[6] ..... F02M 45/00; F02M 47/02

[52] U.S. Cl. ..... 239/88; 239/90; 239/93; 239/95; 239/533.4

[58] Field of Search ..... 239/88, 89, 90, 239/91, 92, 93, 94, 95, 96, 533.2, 533.3, 533.4, 533.5

[56] References Cited

U.S. PATENT DOCUMENTS

| | | | |
|---|---|---|---|
| 3,951,117 | 4/1976 | Perr . | |
| 4,280,659 | 7/1981 | Gaal et al. . | |
| 4,467,963 | 8/1984 | Sisson et al. | 239/91 X |
| 4,557,240 | 12/1985 | Sakuranaka . | |
| 4,951,631 | 8/1990 | Eckert . | |
| 4,976,244 | 12/1990 | Eckert . | |
| 4,986,472 | 1/1991 | Warlick et al. . | |
| 5,037,031 | 8/1991 | Campbell et al. . | |
| 5,209,403 | 5/1993 | Tarr et al. . | |
| 5,275,337 | 1/1994 | Kolarik et al. . | |
| 5,299,738 | 4/1994 | Genter et al. . | |
| 5,301,876 | 4/1994 | Swank et al. . | |
| 5,320,278 | 6/1994 | Kolarik et al. . | |
| 5,323,964 | 6/1994 | Doszpoly et al. . | |
| 5,445,323 | 8/1995 | Perr et al. . | |
| 5,611,317 | 3/1997 | Peters et al. . | |

FOREIGN PATENT DOCUMENTS

| | | |
|---|---|---|
| 2222209 | 2/1990 | United Kingdom . |
| WO 97/06364 | 2/1997 | WIPO . |

*Primary Examiner*—Andres Kashnikow
*Assistant Examiner*—Robin O. Evans
*Attorney, Agent, or Firm*—Sixbey, Friedman, Leedom & Ferguson; Charles M. Leedom Jr.

[57] ABSTRACT

An improved cam operated, open nozzle, unit injector is disclosed including an injector body formed by a barrel, spring housing, and nozzle and containing a central bore for receiving a variable length plunger assembly mounted for reciprocal movement within the injector body wherein the variable length plunger is formed by an outer plunger and inner plunger combined with a timing plunger, mounted between the inner and outer plungers to form a collapsible timing chamber into which a variable quantity of fuel may be metered and expelled on a cycle by cycle basis to provide a variable effective length to the plunger assembly to cause controlled variation in injection timing based on variation in the timing fluid supplied to the injector and wherein the timing plunger is provided with a radial flange for engaging a stop formed in the injector barrel to hold the timing plunger in a predetermined precise location during metering of timing fluid into the collapsible timing chamber and to render the injector timing insensitive to unpredictable pressure variations. The disclosed injector may include a damping chamber for receiving the radial flange of the plunger to eliminate damaging engagement between the timing plunger and the injector barrel. Improved fuel flow passages, check valves and an improved coupling between the outer plunger and the injector's outer return spring are provided along with means for easily changing the rated injection quantity of the disclosed injector.

49 Claims, 6 Drawing Sheets

UNIT INJECTOR WITH HARD STOP TIMING PLUNGER

TECHNICAL FIELD

The present invention relates to a unit fuel injector having an open nozzle and a cam driven, multi-part, reciprocating plunger assembly including a reciprocating timing plunger that forms a variable length hydraulic link for varying the timing of fuel injected into the combustion chamber of an internal combustion engine.

BACKGROUND OF THE INVENTION

Commercial necessity and governmental mandates have greatly increased the performance demands on the fuel systems of modern internal combustion engines. Such demands are especially rigorous for fuel systems used on compression ignition (diesel) engines. In particular, these engines must meet extremely challenging fuel efficiency and competitive cost objectives imposed by sophisticated commercial fleet and industrial users. They must also meet ever increasing emission control standards mandated by various governments around the world.

Among fuel system designers, there exists general agreement that increased emission standards will normally require operation at elevated injection pressure (e.g. above 15,000 to 18,000 psi). In addition, more accurate control over injection timing based on engine operating conditions will also be required. Meeting these demands is difficult enough from an engineering view point but is especially difficult in light of the commercial necessity of minimizing fuel system cost. Such cost is already a substantial part of the total manufacturing cost associated with most commercially available compression ignition engines.

One of the most successful fuel systems supplied for use on compression ignition engines has been the open nozzle, unit injector system pioneered by the Cummins Engine Company, Inc., assignee of the subject invention. This type of fuel system is characterized by a fuel injector including a cam driven reciprocating plunger and a nozzle containing injection orifices which remain open to the combustion chamber even when the reciprocating plunger is retracted to allow fuel to be metered into the injector prior to injection. This type of injector is characterized by greater simplicity as compared with injectors which employ a needle tip valve for closing the injector's orifices. An example of an early form of an open nozzle injector is illustrated in U.S. Pat. No. 4,280,659 to Gaal et al.

To increase the versatility of this type of injector and increase the fuel economy of an engine equipped therewith while improving the engine's performance, the single piece injector plunger has been replaced by a multi-element plunger assembly to form a variable volume timing chamber into which a controlled amount of incompressible liquid (such as fuel) can be metered and expelled on a cycle by cycle basis to vary the effective length of the injector plunger. See for example, FIGS. 16 and 17 of U.S. Pat. No. 3,951,117 to Julius Perr. Because the plunger reciprocation is controlled by a cam rotated in fixed synchronization with the engine's crank shaft, the timing of injection can be varied by varying the effective length of the injector's plunger assembly.

An important feature of the successful Cummins style open nozzle injector is its use of hydraulic control over both fuel metering and fuel timing. As discussed in much greater detail in U.S. Pat. No. 3,951,117, the amount of fuel metered into the metering chamber and the amount of timing fluid (such as an incompressible liquid, e.g. fuel) metered into the variable length timing chamber may be controlled by delivering the fuel and timing liquid through restricted orifices, respectively, and by varying the pressure of the supplied fuel or timing fluid to cause the amount of fuel/timing fluid, metered into the respective injector chambers, to be a function of pressure and the time available for metering. Such metering is known as pressure/time PT metering.

A number of additional patents have issued to the assignee of this invention, Cummins Engine Company, Inc., which are directed to open nozzle unit injectors having a timing plunger for forming a collapsible hydraulic link for varying the effective length of an injector plunger assembly to control the timing of injection on a cycle by cycle basis. See for example:

| Patent No. | Inventor |
|---|---|
| 4,986,472 | Warlick, Timothy A. et al. |
| 5,275,337 | Kolarik, Oldrich S. et al. |
| 5,299,738 | Genter, David P. et al. |
| 5,301,876 | Swank, Bryan W. et al. |
| 5,320,278 | Kolarik, Oldrich S. et al. |
| 5,323,964 | Doszpoly, Bela et al. |
| 5,445,323 | Perr, Julius P et al. |
| WO 97/06364 | Peters, Lester L. et al. |

While effective for the purposes intended, open nozzle unit injectors are subject inherently to unpredictable operational variations resulting from a variety of factors including the metering chamber of the injector remaining open during the period of injection plunger retraction. Ignition of the fuel/air mixture in the corresponding combustion chamber can cause combustion gases to be blown back into the fuel metering chamber of the injector thereby imparting variable pressure within the metering chamber and imparting varying pressure to the lowest plunger forming the injector's plunger assembly. This pressure variation can cause the amount of metered fuel/timing fluid to vary unpredictably in the subject injector or other injectors mounted in the same engine and supplied with fuel/timing fluid through common rails.

A variety of techniques have been employed in an attempt to ameliorate the problems associated with undesired variation in the supply pressure in fuel injection systems using open nozzle injectors wherein the fuel and/or timing fluid is metered based on variation in the supply pressure. For example, a check value may be placed in the supply rail such as illustrated at 522 and 533 of FIG. 16 of the Perr '117 patent. Note also U.S. Pat. No. 5,611,317 which discloses a check valve adjacent the fuel metering chamber for limiting the effect of pressure variations in the fuel metering chamber of the injector.

As disclosed in U.S. Pat. No. 5,037,031, open nozzle injectors are also prone to malfunction due to carboning of fuel in the injector. This patent discloses a technique for minimizing the effect of carboning of open nozzle injectors by use of a labyrinth flow area formed by a specially designed cup bore and stepped inner plunger. U.S. Pat. No. 5,209,403 discloses scavenging flow to remove blow back gases and to cool the injector and also discloses the use of check valve 57, col. 7, lines 25+. See also check valve 46 of U.S. Pat. No. 5,445,323 for use in the scavenging flow path of a open nozzle fuel injector.

While effective for the purposes intended, undesired variation in the timing and metering of fuel injection in open nozzle unit injectors may still occur. For example, the combustion of fuel within one combustion chamber of a multi-cylinder internal combustion engine equipped with open nozzle unit injectors having hydraulically variable timing as described above can have the effect of creating pressure pulses in the supply, drain or timing lines (rails) leading to adjacent unit injectors. These pressure pulses are only partially diminished by the check valves and plunger positioning used in the references disclosed above to prevent undesirable pressure variation in the rail lines supplying and draining the various injectors.

In other types of fuel injection systems, such as unit injectors having closed nozzles as disclosed in U.S. Pat. Nos. 4,976,244 and 4,951,631 or such as pump/distributor systems as disclosed in U.S. Pat. No. 4,557,240, timing plungers are used to provide variation in injection timing. Some of these timing plungers include radial flanges for positively stopping the corresponding timing plunger when the plunger flange engages a stop surface. However, such teachings to not suggest how to avoid the effects of pressure variations occurring in open nozzle unit injectors equipped with variable hydraulic timing.

A need therefor exists for an open nozzle, unit injector which employees variable hydraulic timing but overcomes the deficiencies of the prior art as discussed above. In particular, a need exists for such an injector which is less susceptible to unpredictable timing variations.

SUMMARY OF THE INVENTION

It is a primary object of the present invention to provide a cam operated, open nozzle unit fuel injector having hydraulically variable timing that overcomes the deficiencies of the prior art by reducing unpredictable timing variations.

A more specific object of this invention is to provide an open nozzle unit fuel injector including an injector body and a cam operated plunger assembly mounted for reciprocal movement within a bore contained in the injector body and including a timing plunger for forming a variable length hydraulic link wherein retraction of the timing plunger is positively arrested at a predetermining location during each successive cycle of the injector.

Another more specific object of the subject invention is to provide an open nozzle unit fuel injector including an injector body and a cam operated plunger assembly mounted for reciprocal movement within the injector body and including a timing plunger and a timing plunger stop for positively arresting retraction of the timing plunger at a predetermined location while the length of the hydraulic link is being set for the next injection cycle in response to a control signal, whereby the effective length of the hydraulic link can be reliably and predictably set on a cycle by cycle basis in response to the control signal.

Yet another object of the subject invention is to provide an open nozzle unit fuel injector of the type described above including a timing plunger having a radially outwardly directed flange upon which is formed a radially oriented stop engaging surface for engaging a stop surface formed within the injector body.

Still another object of the subject invention to provide an open nozzle unit fuel injector of the type described above including damping means for absorbing momentum of the timing plunger as said timing plunger approaches the predetermined location. In particular, the damping means may include a damping chamber into which the radially outwardly directed flange is received as the timing plunger approaches the predetermined location.

Another object of the subject invention to provide an open nozzle unit fuel injector of the type described above wherein the damping chamber is normally filled with fuel which is displaced by the radially outwardly directed flange as the timing plunger nears the predetermined stop location and wherein the damping chamber includes a radially inwardly directed flange positioned and shaped to form a fluid flow constricting gap with the radially outwardly directed flange as the radially outwardly directed flange enters the damping chamber.

Another object of the subject invention to provide an open nozzle unit fuel injector of the type described above wherein a timing chamber is formed in the bore between the outer plunger and the timing plunger and further wherein the injector body contains at least one timing fluid feed passage which communicates with the collapsible timing chamber for metering a controlled amount of timing fluid into the collapsible timing chamber during each successive injector cycle while the timing plunger and outer plunger are retracted.

Still another object of the subject invention to provide an open nozzle unit fuel injector of the type described above wherein the control signal for varying timing during successive cycles is a variable pressure timing fluid and wherein the timing fluid feed passage includes a constricting orifice to cause the amount of timing fluid metered into the collapsible timing chamber to vary during each successive cycle dependent on the pressure of the timing fluid.

Another object of the subject invention to provide an open nozzle unit fuel injector of the type described above wherein the injector body contains a timing fluid spill passage communicating with said collapsible timing chamber and located to communicate with the collapsible timing chamber when the timing plunger nears its fully advanced position to allow the timing fluid metered into the collapsible timing chamber to be expelled thereby collapsing the hydraulic link between the outer plunger and the timing plunger during each successive cycle.

Another object of the subject invention to provide an open nozzle unit fuel injector of the type described above wherein the flow of timing fluid from the timing chamber is restricted to create a hold down force on the timing plunger and wherein the timing fluid spill passage communicates with the exterior of the injector body through a spill port, and the injector further includes a resilient element covering the spill port biased to form the restriction to flow of the timing fluid out of the collapsible timing chamber.

Another object of the subject invention to provide an open nozzle unit fuel injector of the type described above wherein variable length plunger assembly further includes an inner plunger for forming a fuel metering chamber at the inner end of the injector bore when the variable length plunger assembly is retracted and for causing fuel metered into the fuel metering chamber to be injected into the combustion chamber through the open injection orifice as the plunger assembly is advanced and the injector body contains a fuel feed passage communicating with a source or fuel at a selectively variable pressure and with the metering chamber when the inner plunger is adjacent its retracted position, and wherein the fuel feed passage includes a metering orifice for constricting the flow of fuel into the metering chamber whereby the amount of fuel that is metered into the metering chamber during each successive cycle is dependent upon the pressure of the fuel supplied to the injector.

Another object of the subject invention to provide an open nozzle unit fuel injector of the type described above further including an inner return spring located within the injector bore for continuously biasing the inner plunger toward its fully retracted position and wherein the injector body includes a barrel containing an outer portion of the injector bore within which the outer plunger and timing plunger are mounted for reciprocal movement, and further including a spring housing threadedly connected to the inner end of the barrel and containing therein a spring chamber for receiving the inner return spring and including a nozzle containing an inner portion of the bore within which the inner plunger is mounted for reciprocal movement, the nozzle containing the injection orifice at its innermost end, and further including a nozzle retainer for telescopingly receiving the nozzle and for threadedly engaging the spring housing to hold the outer end of the nozzle in contact with the spring housing.

Another object of the subject invention to provide an open nozzle unit fuel injector of the type described above wherein the spring housing contains a first portion of the fuel feed passage and the nozzle contains a second portion of the fuel feed passage in fluid communication with the first portion and further including at least one pin for holding the spring housing and the nozzle in a fixed predetermined rotational position to insure that the first and second portions of the fuel feed passage remain in fluid communication and wherein the second portion of the fuel feed passage includes a recess for receiving a check valve element for preventing reverse flow of fuel or combustion gas from said metering chamber into said first portion of the fuel feed passage.

Another object of the subject invention to provide an open nozzle unit fuel injector of the type described above wherein the first portion of the fuel feed passage includes a threaded recess for receiving a threaded plug containing the metering orifice.

Yet another object of the subject invention to provide an open nozzle unit fuel injector of the type described above further including a spring guide pressed on the outer end of the inner plunger and arranged to engage the outer end of the inner return spring to bias the inner plunger toward the inner end of the timing plunger, and wherein the spring guide and inner plunger extend the same distance in the outer direction to contact the inner end of the timing plunger.

These and other important objectives, advantages and features are achieved by providing an open nozzle fuel injector including an injector body containing an internal bore and plural injection orifices and a variable length plunger assembly (including an outer plunger, inner plunger and timing plunger for forming a variable length hydraulic link) mounted for reciprocal movement within said internal bore during the successive injection cycles wherein the timing plunger includes a radial flange for engaging a stop formed in a barrel of the injector body to provide a timing plunger stop means for positively arresting retraction of said timing plunger at a predetermining location while the length of said hydraulic link is being set for the next injection cycle in response to a hydraulic control signal thereby allowing the effective length of the hydraulic link to be reliably and predictably set on a cycle by cycle basis in response to the hydraulic control signal. The radial flange of the timing plunger is adapted to enter a fluidic damping chamber as the timing plunger nears its fully retracted position to cause the retraction velocity of the timing plunger to be reduced thereby eliminating damaging collision of the timing plunger with the injector barrel. Check valves are provided in the fuel feed passages and drain passages contained in the injector nozzle. The unit injector also includes improved inner and outer spring couplings and guides to reduce coupling failures and slippage. In one embodiment, the rated fuel injection capability of the unit injector may be varied by replacement of a different constricting orifice plug threadedly mounted in the spring housing of the injector and/or by the provision of a second fuel feed passage in the spring housing and nozzle.

Still other advantages, features and objectives can be understood by consideration of the following summary of the drawings and description of the preferred embodiments.

DETAILED DESCRIPTION OF THE PREFERRED EMBODIMENTS

Figure 1:
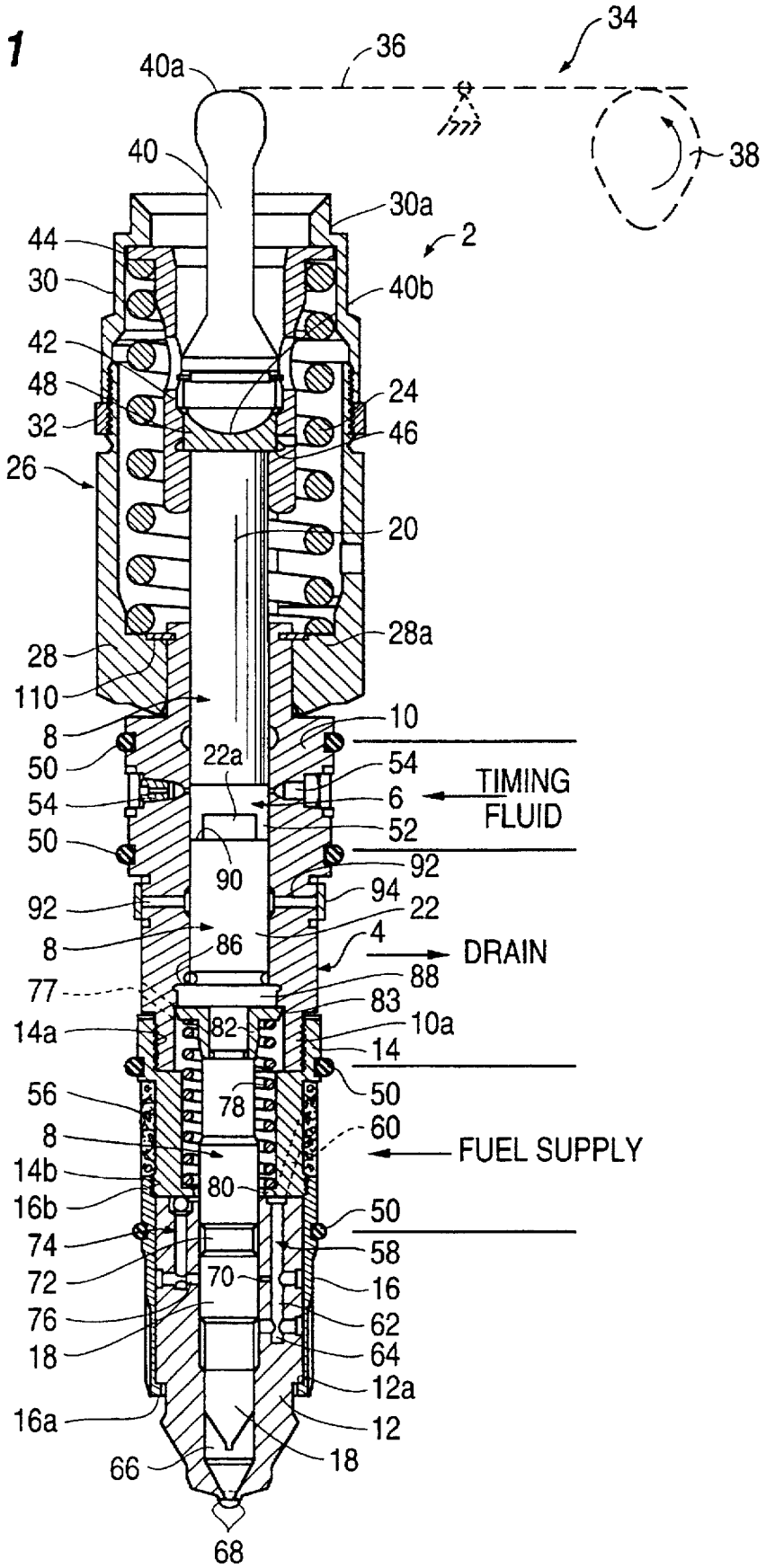
FIG. 1 is a cross sectional view of a unit injector designed in accordance with the subject invention.

Referring now to FIG. 1, one example of a cam operated, open nozzle fuel injector 2 is disclosed for achieving the objects, advantages and features of the subject invention. In particular, injector 2 is designed to inject fuel into the combustion chamber of an internal combustion engine (not illustrated) such as a compression ignition (diesel) engine. Such an engine may have a single cylinder but is preferably a multi-cylinder engine having a corresponding piston mounted in each cylinder to form a variable volume combustion chamber into which fuel is injected by a corresponding fuel injector of the type illustrated in FIG. 1. Each piston is connected to a single crankshaft for causing the pistons to execute successive strokes forming identical cycles (2 or 4 cycles) during which fuel and air is introduced, burned and exhausted from the combustion chamber. The injection of fuel of a predetermined quantity at a precisely controlled time during each successive set of cycles can be crucial to achieving both efficient fuel consumption and low emissions.

For purposes of this description, the words "inner" and "outer" will describe the location with respect to the combustion chamber into which fuel is injected. In particular, "inner" will mean close to or toward the combustion chamber and "outer" will mean away from the combustion chamber.

Injector 2 includes an injector body 4 containing a central bore 6 within which is mounted for reciprocal movement a plunger assembly 8. As will be described in more detail below, plunger assembly 8 reciprocates in response to rotation of an associated cam, not illustrated, which is synchronized with the movement of an associated engine piston (not illustrated). The injector body 4 includes three major components including a barrel 10, a nozzle 12, and a spring housing 14. The spring housing 14 contains at its outer end an internally threaded recess 14*a* for receiving the externally threaded inner end 10*a* of barrel 10. The outer end of nozzle 12 is held in contact with the inner end of spring housing 14, by means of a nozzle retainer 16.

As shown in FIG. 1, nozzle retainer 16 is a generally cylindrical sleeve having a radially in turned lip 16*a* which forms a shoulder for contacting a complementary ledge 12*a* of nozzle 12. The hollow portion of retainer 16 is shaped to receive nozzle 12 telescopically and is internally threaded at its outer end 16*b* for mating with the external threads on the inner end 14*b* of housing 14. Each of the nozzle 12, spring housing 14 and barrel 10 contains a portion of the central bore 6. The central bore portions are aligned to receive the plunger assembly.

Plunger assembly 8 includes an inner plunger 18 mounted for reciprocal movement within the portion of the central bore 6 contained in nozzle 12, and an outer plunger 20 mounted for reciprocal movement within the portion of central bore 6 contained in barrel 10. Located intermediate inner plunger 18 and outer plunger 20 is a timing plunger 22, mounted for reciprocal movement within the portion of central bore 6 contained within barrel 10.

Outer plunger 20 is biased in the outward direction by an outer spring 24. An outer spring housing assembly 26 is mounted on the outer end of barrel 10, formed by an inner section 28 and an outer section 30 threadedly joined to allow the effective axial length of the outer spring housing assembly 26 to be adjusted as the inner and outer sections are relatively rotated. A lock nut 32 is threadedly mounted on the outer externally threaded portion of inner section 28, to allow the inner section 28 and outer section 30 to be locked in position once the sections are rotationally adjusted to define the desired length.

Inner section 28 of the outer spring housing assembly 26 is formed with an outwardly opening recess to define an inner ledge 28*a* for supporting the inner end of outer spring 24. Outer section 30 is formed with an inwardly opening recess to define an outer ledge 30*a* for arresting outward movement of the inner plunger 20. Outer plunger 20 is biased toward its outermost, fully retracted position illustrated in FIG. 1 by means of outer spring 24. This outermost position may be adjusted by relatively rotating inner section 28 and outer section 30. Inward movement of plunger assembly 8 is caused by an injector drive train 34 (illustrated in dash lines) which may include a rocker arm 36 contacted at one end by rotating a cam 38 and connected at the other end to the upper portion of outer plunger 20, by means of a link 40 having a spherical outer surface 40*a* engaged by a complementary surface (not illustrated) at the contacting end of rocker arm 36, and including an inner spherical surface 40*b*.

A generally hollow coupling 42 is connected with the outer end of outer plunger 20. Coupling 42 includes at its outer end a radially outwardly directed flange 44 adapted to engage, on its inner side, the outer end of outer spring 24. On its outer side, flange 44 is adapted to engage the outer ledge 30*a* of outer section 30 of the spring housing assembly. Ledge 30*a* thus forms a coupling stop for defining the fully retracted position of outer plunger 20. Coupling 42 is arranged to receive the inner end of link 40 and is further provided with a radially inwardly directed ledge 46 for forming at least partially the bottom wall of the coupling recess and defining an opening for receiving the outer end of outer plunger 20.

As illustrated in FIG. 1, coupling 42 is fixed to outer plunger 20 in a position to cause the outermost end of outer plunger 20 to align flush with the inwardly directed ledge 46 to form the inner floor of the coupling recess. Further included within coupling 42 is a thrust plate 48 positioned to contact on its inner side both the ledge 46 and the outer end of outer plunger 20. The outer side of thrust plate 48 is formed with a concavity complementary to the inner spherical surface 40*b* of link 40. This arrangement of the thrust plate 48 in contact with both the ledge 46 and the upper end of outer plunger 20 causes the inwardly directed force imparted by the injector drive link 40 to be imparted to both the outer plunger 20 and to the coupling whereby any tendency of the coupling to move axially, relative to the outer plunger is avoided.

As is described in more detail in the above identified Cummins patents, especially U.S. Pat. Nos. 5,299,738 and 5,275,337 (incorporated herein by reference), open nozzle unit injectors normally include a plunger assembly 8, which has a variable effective link, on a cycle by cycle basis, dependent upon a control signal based upon engine, environmental and/or operator imposed conditions. In the specific embodiment of FIG. 1, this control signal takes the form of a variable pressure timing fluid supplied to the injector via a common passageway (rail) formed within the engine head (not illustrated). Each unit injector is normally received within an injector cavity, formed within the engine head, which communicates with the timing fluid rail as is more fully disclosed in the '738 and '337 Cummins patents noted above. Similarly, separate passageways (rails), formed within the engine head, also communicate with each of the injector receiving cavities within the engine head to provide a supply of fuel under variable pressure and to receive fuel drained from the injector. Since the timing fluid is typically engine fuel, a single drain serves to receive timing fluid expelled from the timing chamber of the injector on a cycle by cycle basis as well as fuel received from the inner portion of the injector. Fuel is used to cool the inner portion of the injector and to lubricate the inner plunger. Fuel may also be used to scavenge gasses and/or fill voids in the fuel lines. The drain passage may also receive any fuel that may have leaked from internal portions of the fuel injector. The fuel contained in the timing, drain and fuel supply rails, are isolated within each injector-receiving cavity by means of seals, such as o-ring seals 50 as illustrated in FIG. 1.

The effective length of the plunger assembly is changed by varying the amount of timing fluid metered into a variable length and collapsible timing chamber 52 formed between outer plunger 20 and timing plunger 22. In FIG. 1, outer plunger 20 is illustrated in its fully retracted position in which a plurality of timing of fluid feed passages 54 are cause to communicate fluidically with the collapsible timing chamber 52. As will be explained more thoroughly herein below, each timing fluid feed passage 54 includes a constricting orifice of predetermined size to cause the amount of timing fluid metered into the collapsible timing chamber 52 to be highly sensitive to variation in the pressure of the timing fluid supplied to each injector. Obviously, the amount of timing fluid metered into the timing chamber 52 will also be dependent upon the amount of time that the outer plunger resides within its fully retracted position. Timing and fluid pressure can thus be modified in response to engine speed, engine load and other factors to advance or retard injector timing on a cycle by cycle basis.

Cam 38 rotates further to cause link 40 to apply downward pressure on outer plunger 20 and thereby to cause plunger 20 to be advanced inwardly to cut off further metering of timing fluid. The amount of timing fluid metered into chamber 52 will be trapped to form a hydraulic link whose effective length will depend upon the amount of timing fluid trapped within the timing chamber 52. Further advance of outer plunger 20 will cause timing plunger 22 to advance inwardly thereby causing inner plunger 18 to also advance inwardly.

At the same time that timing fluid is metered through timing fluid feed passages 54 into the timing chamber 52, fuel supplied in the fuel supply rail is caused to pass through a fuel filter 56 through a fuel feed passage 58. As will be discussed in more detail herein below, fuel feed passage 58 includes a first portion 60 contained in the spring housing 14 and shown out of plane by dashed lines in FIG. 1. First portion 60 of fuel feed passage 54 is oriented generally axially toward injector nozzle 12 where it fluidically connects to a second portion 62 of the fuel feed passage 58 contained in nozzle 12. The lower end of the second portion 62 includes a radial section 64 which opens into central bore 6. The opening into central bore is only fully opened when the inner plunger 18 is adjacent its fully retracted outward position as illustrated in FIG. 1. When inner plunger 18 is in this location, fuel from the fuel supply rail is allowed to pass into a metering chamber 66 formed in the inner end of central bore 6 as inner plunger 18 moves outwardly. The inner end of plunger 18 and the corresponding portion of the central bore is shaped to provide a labyrinth flow area to reduce trapped volume and reduce the negative impact of carbon deposits which may form within the metering chamber due to the open nozzle of the fuel injector illustrated in FIG. 1. In particular, the innermost portion of central bore 6 is fluidically connected with the combustion chamber through a plurality of tiny injection orifices 68 Combustion gases which form in a combustion cylinder may at times be blown back through orifices 68. Such blowback plus the hot temperature caused by fuel combustion within the combustion chamber may lead to carbon deposits within the metering chamber. The stepped labyrinth flow area does not necessarily eliminate carboning but tends to reduce the negative effect of such carboning. The benefits of this arrangement are described further in U.S. Pat. No. 5,037,031 assigned to the same assignee as this invention and incorporated herein by reference.

Second portion 62 of the fuel feed passage 58 includes a second radial section 70 to allow cross-flow of fuel from the fuel feed passage whenever the annular recess 72 of inner plunger 18 aligns with the opening of the second radial section 70 into the central bore 6. Such cross-flow fuel is received in a drain passage 74 which includes a radial section 76 communicating with the central bore 6. After entering radial section 76, the fuel moves upwardly through the axial portion of drain passage 74 into the hollow interior of the spring housing 14. Fuel is drained from the interior of spring housing 14 through a plurality of upward radial passages 77 one of which is shown out of plane by dashed lines in FIG. 1.

A check valve may be included to prevent reverse flow in the fuel feed passage 58, and a second check valve may be placed in the drain passage 74 in a similar manner to prevent reverse flow of fuel passing through the drain passage 74. Such check valves may be formed in the upper portion of nozzle 12 as will be discussed in greater detail herein below.

To cause inner plunger 18 to be biased outwardly into contact with timing plunger 22, an inner spring 78 is provided. The lower end of inner spring 78 contacts a spring support surface 80 formed at the inner end of spring housing 14. A spring guide 82 is mounted on the outer end of inner plunger 18. The spring guide 82 includes an outwardly directed flange 83 for engaging the outer end of the inner return spring 78. The upper surface of the spring guide 82 is arranged to directly contact the lower surface of the timing plunger 22 and is generally aligned flush with the upper most end of inner plunger 18 to avoid any tendency of spring guide 82 to move from its fixed position on the outer end of inner plunger 18.

A very important feature of the subject invention is the provision of a timing plunger stop means for positively arresting retraction of the timing plunger at a predetermined location during the period of timing fluid metering into the timing chamber 52. By fixing precisely the location of timing plunger 22 during the timing fluid metering phase of injector operation, adverse effects are avoided on the amount of timing fluid metered into timing chamber. Such adverse effects, that are often unpredictable and/or unavoidable, are produced for example by changes in pressure within the combustion chamber that, in turn, give rise to pressure pulses that are reflected into the metering chamber 66 through injection orifices 68. These types of unpredictable and uncontrolled pressure changes are especially prevalent in open nozzle fuel injectors of the type illustrated in FIG. 1. Similarly, such pressure changes can be reflected back through the fuel supply and into the common drain passage or rail, which may further result in unpredictable changes in the amount of timing fluid metered into the timing chamber unless the timing plunger can be fixed in its location during the metering period for the timing fluid. Other undesirable pressure pulses and effects may be transmitted through the common rails from one injector to another, particularly when combustion is occurring in one combustion chamber associated with a first injector while another injector, connected with the same common rails, has its plunger assembly fully retracted to cause fuel and timing fluid to be metered into it.

Figure 8:
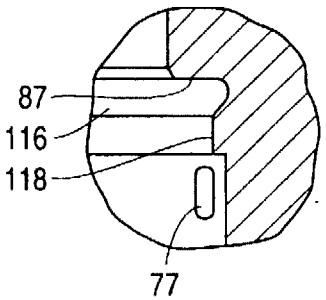
FIG. 8 is a enlarged, broken away, cross sectional view of the timing plunger stop and damping chamber formed within the barrel, illustrated in FIGS. 5–7, taken along lines 8'—8' of FIG. 7.
Figure 6:
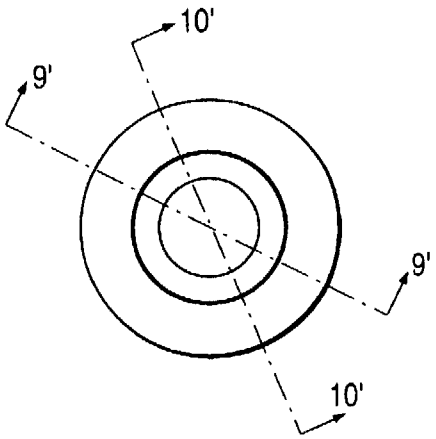
FIG. 6 is a top elevational view of the barrel illustrated in FIG. 5.

As will be described more fully herein below, the timing plunger 22 includes a radially oriented stop engaging surface 86 formed on a radially outwardly directed flange 88. As is also further described herein below, flange 88 is shaped to enter a complementarily formed damping chamber 116 formed in barrel 10 by an undercut in central bore 6 adjacent the inner end of barrel 10 (FIG. 8). The fully retracted (outward position) of the timing plunger 22 is defined by engagement of the radially oriented stop engaging surface 86 with a stop 87 (FIG. 8) formed by a radial surface defining in part damping chamber 116. The damping chamber 116 typically fills with fuel whenever the timing plunger is advanced inwardly. Upon outward movement of the timing plunger, the fuel contained in the damping chamber must be dispelled through a restricted passage formed between the outer circumferential surface of flange 88 and a complementary inwardly directed flange 118 (see FIG. 8) formed in barrel 10.

The upper end of timing plunger 22 is formed with a reduced diameter projection 22*a* shaped and positioned to cause one or more spill passages 92 to be opened as timing plunger 22 nears its innermost position to allow timing fluid to be dispelled from the timing chamber 52. A resilient spring-like band is placed at least partially around the circumference of barrel 10. The resilient spring-like element 94 (FIG. 1) is formed to resiliently engage the outer surface of the barrel and close off the the spill ports 93 formed by the intersection of the spill passages 92 with the exterior surface of the barrel 10. The construction and advantages of using a resilient spring-like element 94 extending in a band like circumferential orientation around at least a substantial portion of barrel 10 are disclosed in much greater detail in U.S. Pat. No. 5,275,337 assigned to the same assignee as this invention and incorporated herein by reference. In particular, spring-like element 94 accurately controls the amount of back pressure created as the inner plunger reaches its inward most position and timing fluid is spilled from timing chamber 52 through the spill passages 92. This controlled pressure creates a predictable predetermined hold down pressure to ensure that forces imposed on the cam and the injector drive train are maintained below an upper limit while adequate pressure is applied to the inner plunger 18 to hold its inner end against the lower most portion of the central bore 6 formed in nozzle 12, thereby avoiding bounce back of the inner plunger. This arrangement assures a clean cutoff of fuel injection and thus reduces undesirable engine emissions.

The provision of a damping chamber 116, into which the radially outwardly directed flange 88 is caused to enter as timing plunger 22 reaches its outermost position, is highly desirable in that it tends to moderate the velocity of plunger 22 as flange 88 comes into engagement with the timing plunger stop formed by barrel 10. The desirability of cushioning the outward movement of the inner plunger as it reaches its outermost position, is discussed in U.S. Pat. No. 5,299,738 the disclosure of which is hereby incorporated by reference. However, provision of a means for arresting the timing plunger in a fixed outermost position is unique to the subject invention. Damping of outward movement as the timing plunger 22 reaches its outermost position has the effect of similarly damping outward movement of the inner plunger 22, since inner spring 78 causes both the inner plunger 18 and timing plunger 22 to be biased outwardly together.

Figure 2:
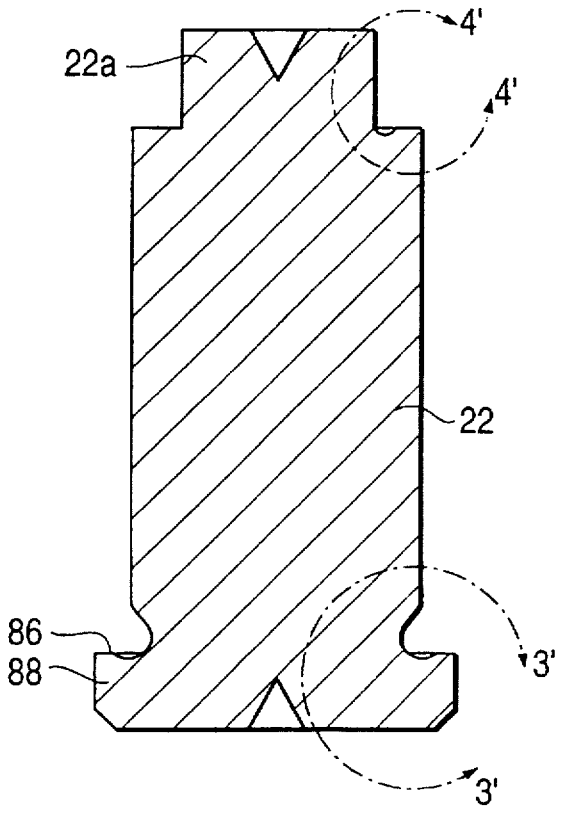
FIG. 2 is an enlarged, cross sectional view of the improved timing plunger employed in the unit injector of FIG. 1.
Figure 4:
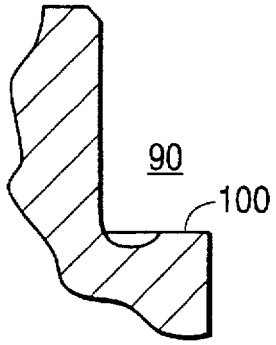
FIG. 4 is an enlarged, broken away, cross sectional view of the reduced diameter projection at the outer end of the timing plunger illustrated in FIG. 2 taken along lines 4'—4'.
Figure 3:
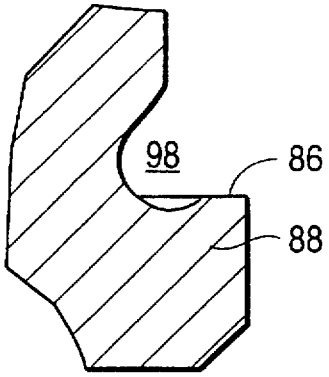
FIG. 3 is an enlarged, broken away, cross sectional view of the radial flange of the timing plunger show in FIG. 2, taken along lines 3'—3'.
Figure 9:
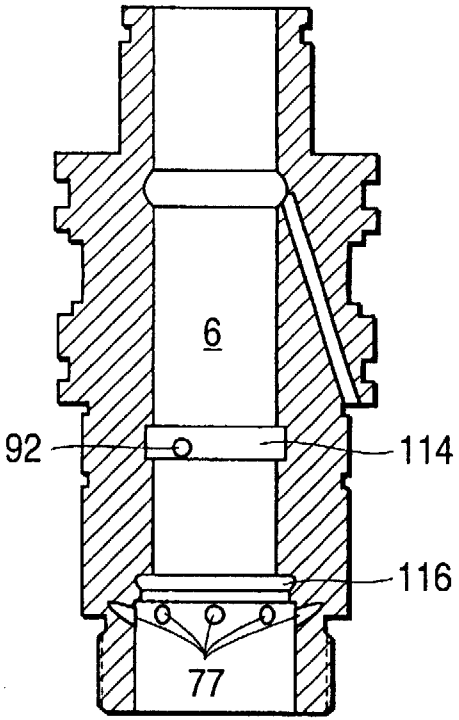
FIG. 9 is a cross-sectional view of the barrel illustrated in FIGS. 5–7, taken along lines 9'—9' of FIG. 6.

Reference is now made to FIGS. 2–4 which disclose, in greatly enlarged form, the configuration of timing plunger 22. In particular, the radially outwardly directed flange 88 at the inner end of timing plunger 22 is shown in more graphic detail. On the outer side of this flange, the radially oriented stop engaging surface 86 is formed. As shown in greater detail in the cut-away view of FIG. 3, the zone in which flange 88 joins together with the remaining body of timing plunger 22 is undercut at 98. Similarly, the the outer end of timing plunger 22 is reduced in diameter to form a projection 22*a*. The reduced diameter projection meets a radial surface 100 at an undercut zone 90. Such undercuts promote the precise location of the timing plunger when stopped and preclude fracture of the plunger at the point of juncture between the flange 88 and the remaining body of the timing plunger. Precise control over the commencement of timing fluid spill occurs as surface 100 is advanced inwardly to clear or open the spill passages 92 that communicate with central bore 6.

Centering recesses at 102 may be formed at opposite ends of timing plunger 22 to assist in manufacturing the timing plunger 22 to very close tolerances. The timing plunger may be formed from a variety of materials including ceramic materials to improve the service life of the unit injector and to allow very close tolerances in forming the clearance between the outer surface of plunger 22 and the inner surface of central bore 6. Manufacture of plungers out of ceramic material to very close tolerances is quite difficult particularly if the plunger requires internal passageways. Accordingly, the formation of the disclosed timing plunger out of ceramic is greatly facilitated by the fact that no internal passageways are required yet the timing plunger is capable of precisely controlling the timing and resulting hold down pressure during timing chamber collapse at the end of fuel injection. The advantages of using ceramic material in the fuel injector are discussed in co-pending U.S. patent application Ser. No. 08/803,511 filed Feb. 20, 1997 (attorney docket no. 270-2138), the disclosure of which is incorporated herein by reference.

Figure 5:
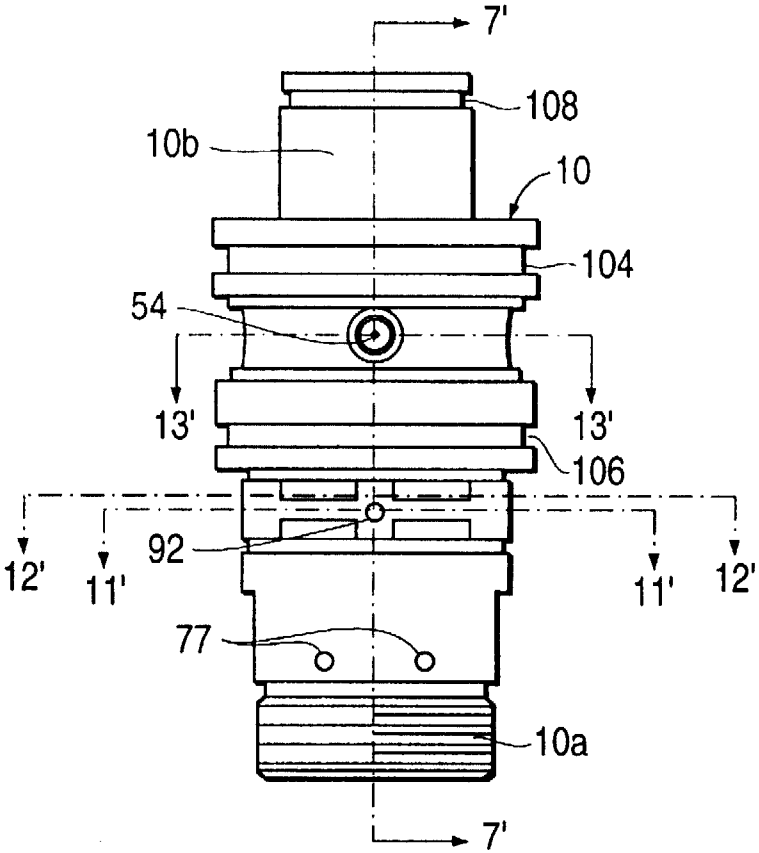
FIG. 5 is a side elevational view of the barrel of the unit injector illustrated in FIG. 1.
Figure 10:
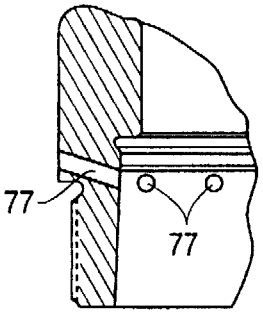
FIG. 10 is an enlarged, broken away cross-sectional view of the barrel illustrated in FIGS. 5–7, taken along lines 10'—10' of FIG. 6.

Reference is now made to FIGS. 5–13, which disclose various views of the barrel 10. In particular, FIG. 5 is a side elevational view of barrel 10. On the external surface of barrel 10 are located grooves 104 and 106 for receiving o-ring seals (50 in FIG. 1) arranged to seal off one portion of the injector receiving cavity of an engine head (not illustrated) which receives the fuel injector of FIG. 1. The sealed off portion communicates with the timing fluid passageway formed in the engine head for delivering timing fluid of varying pressure to the unit injector. The upper end of barrel 10 is characterized by a reduced diameter outer portion 10*b*, designed to be received in a complementary opening formed in the inner section of the outer spring housing assembly 26. A groove 108 is formed in this reduced diameter portion of the barrel 10 to receive a C-shaped, resilient locking element 110 (FIG. 1). Just above the externally threaded inner end portion 10*a* of barrel 10 are illustrated the open ends of a pair of upward radial passages 77. One of these radial passages is shown in dashed lines out of plane in FIG. 1, but as is apparent in FIGS. 6–10, a plurality of such a radial passages 77 may be formed in barrel 10 extending from just below the damping chamber 116, which receives the radial flange 88 of the timing plunger, to the exterior of barrel 10.

Figure 7:
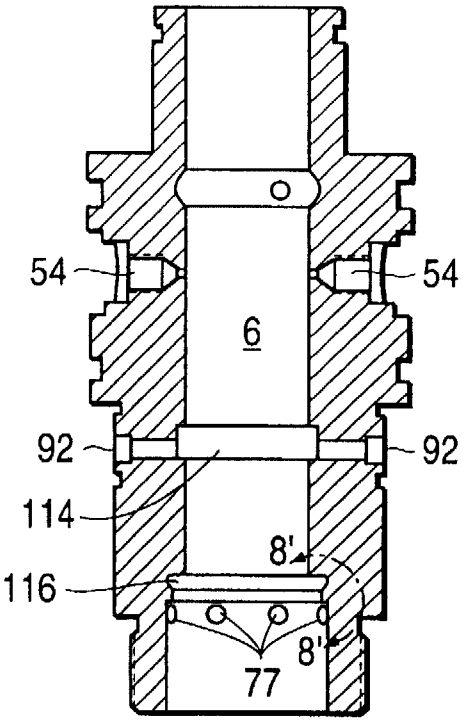
FIG. 7 is a cross sectional view of the barrel illustrated in FIG. 5, taken along lines 7'—7'.
Figure 13:
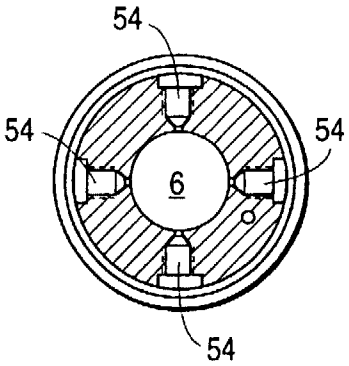
FIG. 13 is a cross sectional view illustrating the timing fluid metering ports contained in the barrel illustrated in FIGS. 5–7 taken alone lines 13'—13' of FIG. 5.
Figure 12:
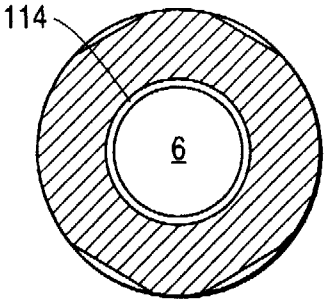
FIG. 12 is a cross sectional view of the barrel, illustrated in FIGS. 5–7 taken along lines 12'—12' of FIG. 5.
Figure 11:
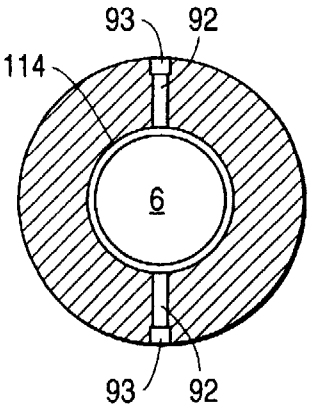
FIG. 11 is a cross sectional view of the barrel, illustrated in FIGS. 5–7, taken along lines 11'—11' of FIG. 5.

As best illustrated in FIGS. 5, 7 and 13, a total of four radially oriented timing fluid feed passages 54 may be provided in barrel 10 between o-ring seal receiving grooves 104 and 106. As best shown in FIG. 13, these feed passages 54 open into central bore 6 at circumferentially spaced, equal angular positions. As best illustrated in FIG. 1, these timing fluid passages 54 open into bore 6 at axial locations that cause the openings to be normally blocked when the outer plunger 20 is advanced. Such passages are uncovered only when the outer plunger 20 is adjacent its fully retracted position, as illustrated in FIG. 1.

Figure 25:
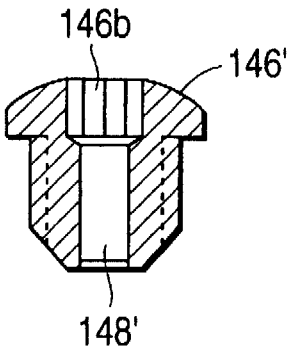
FIG. 25 is an enlarged cross sectional view of an alternative form of the removable plug illustrated in FIG. 24 wherein the constricting orifice is substantially larger to allow for a greater flow of fuel during the injector's metering phase.
Figure 24:
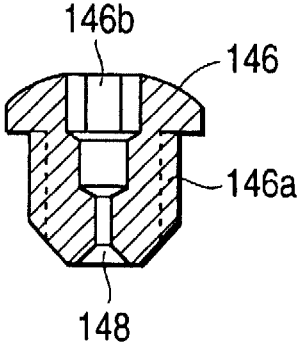
FIG. 24 is an enlarged cross sectional view of a removable plug containing a fuel supply constricting orifice, adapted to be mounted in the spring housing of FIG. 23.

To aid in reducing manufacturing costs and yet enhance the adaptability of a single injector design for a variety of different engine configurations and timing requirements, timing fluid feed passages 54 are enlarged and internally threaded to receive threaded plugs of the type illustrated in FIGS. 24 and 25. Each plug contains a predetermined size of restricted orifice such that the amount of timing fluid which can be metered into the timing chamber will vary substantially with relatively small variation in the pressure of timing fluid supplied to the unit injector. Feed passages 54 are circumferentially equally spaced to provide a predictable even flow of timing fluid into the timing chamber. The quantity of metered timing fluid may be varied on a cycle by cycle basis of unit injector operation. The actual number of feed passages may be increased or decreased as warranted to achieve the desired effect. Also illustrated in FIGS. 5, 7, 9 and 11, are the pair of spill passages 92 arranged along a diametric axis intersecting at right angles the central axis of bore 6. The axial location of passage 92 is selected to cause the timing chamber to remain sealed throughout the greater portion of the inward movement of timing plunger 22.

A circumferential annular groove 114 is formed on the inner wall of central bore 6 as illustrated in FIGS. 7, 9, 11 and 12. The purpose of annular groove 114 is to define precisely the position at which timing fluid will be spilled from the timing chamber 52 and allow the hydraulic link between the outer plunger 20 and the timing plunger 22 to commence collapsing. The discharge of such timing fluid into the common drain passage connecting various injectors of an internal combustion engine, can give rise to pressure pulses which might have the effect of disturbing, unpredictably, the metering of timing fluid into other injectors connected to the same drain rail. Other pressure pulses can arise in the common rails for supplying fuel and timing fluid to the injector and for providing a path for draining fuel from the injector. For example, blowback gases from the combustion chamber can cause pressure pulses to arise in the various common rails serving the injectors. Accordingly, the subject invention avoids such problems by providing a positive stop means to arrest and hold the timing plunger 22 within each injector at a predetermined fixed location during the metering of timing fluid into that injector.

FIG. 8 is a cut-away enlargement of the damping chamber 116 formed just above radial passages 77, but below the portion of the central bore in barrel 10, which closely engages the outer plunger 20. This zone forms the damping chamber 116, which is normally filled with fuel. As the radial flange 88 of the timing plunger 22 moves axially into damping chamber 116, the fuel within chamber 116 is forced out. The circumferential surface of flange 88 is designed to form a constricted flow path with an inwardly directed flange 118 formed in the inner wall of barrel 10. This inwardly directed flange 118 is shaped and positioned to create the desired amount of restriction of flow of fuel out of the damping chamber 116 to provide the appropriate degree of cushioning to arrest the outward movement of the timing plunger 22 and associated inner plunger 18. Outward movement of timing plunger 22 is terminated when stop engaging surface 86 comes into contact with a complementary stop 87 formed by a radially oriented surface forming a wall of chamber 116.

Figure 14:
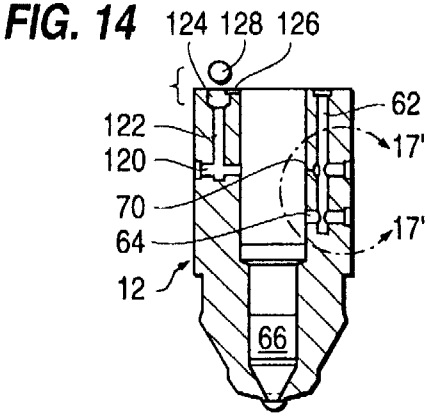
FIG. 14 is a cross sectional view of the nozzle located at the lower end of the unit injector illustrated in FIG. 1.

Turning now to FIG. 14, a cross-sectional view of the unit injector nozzle 12 is illustrated including a second portion 62 of the fuel feed passage 58, which extends axially through the side wall of the nozzle 12. Radial section 64 of fuel feed passage 58 provides a path for metering of fuel into the fuel metering chamber 66, while a second radial section 70 of fuel feed passage 58 is located to allow both cooling and scavenging flow of fuel whenever the inner plunger 18 is adjacent to its innermost position.

Figure 17:
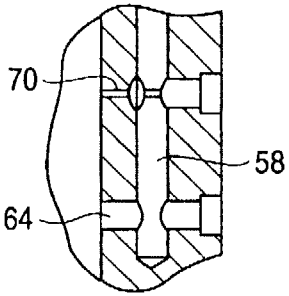
FIG. 17 is an enlarged, broken away, cross sectional view of the axial fuel supply passage contained in the nozzle illustrated in FIGS. 14 and 15 taken along lines 17'—17' of FIG. 14.
Figure 19:
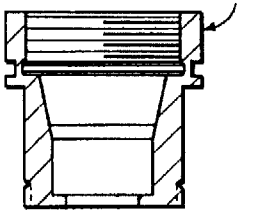
FIG. 19 is a cross sectional view of the spring housing illustrated in FIG. 18 taken along lines 19'—19' of FIG. 18.
Figure 20:
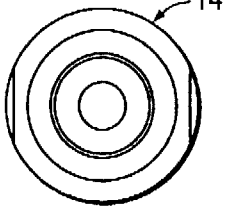
FIG. 20 is a top elevational view of the spring housing illustrated in FIG. 18.
Figure 18:
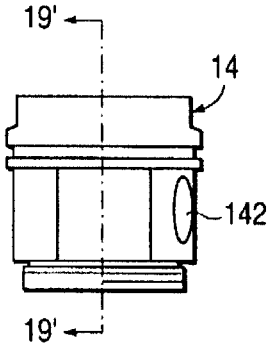
FIG. 18 is a side elevational view of the spring housing located between the nozzle and barrel of the unit injector illustrated in FIG. 1.
Figure 21:
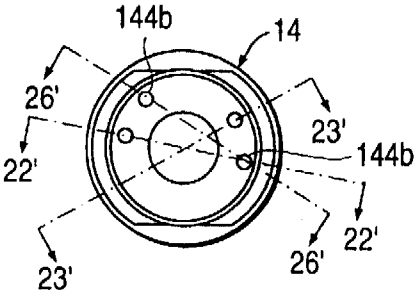
FIG. 21 is a bottom elevational view of the spring housing illustrated in FIG. 18.

FIG. 17 is an enlargement of the section of nozzle 12 circumscribed by lines 17'—17' of FIG. 14. As illustrated in FIG. 17, second radial section 70 has a considerably smaller diameter than does the first radial section 64. The smaller diameter of section 70 operates to restrict the amount of fuel flow to the minimum amount necessary to achieve the desired cooling and scavenging effects. Restricting this flow to the minimum necessary reduces the pumping losses due to excess flow of fuel from the fuel pump of the internal combustion engine. As fuel flows through section 70 and the annular recess 72 of inner plunger 18, fuel passes into drain passage 74 including the first radial section 120, an axial section 122 and a large recess 124. From recess 124, fuel is directed through a radial groove 126 into the hollow interior of the spring housing 14 illustrated in FIG. 1. Recess 124 is sized to receive a valve element 128 (which may be a ball) having an appropriate seat at the outer end of section 122 to thereby prevent reverse flow of fuel from the drain passage 74 into the fuel feed passage 58.

Figure 16:
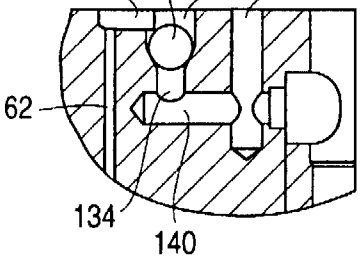
FIG. 16 is an enlarged, broken away, cross sectional view of the fuel supply passages located in the upper portion of the nozzle illustrated in FIGS. 14 and 15 taken along lines 16'—16' of FIG. 15.
Figure 15:
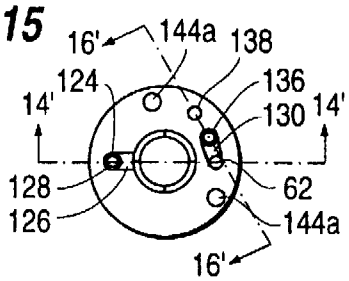
FIG. 15 is a top elevational view of the nozzle illustrated in FIG. 14.

Similarly, the fuel feed passage 58 may be provided with a check valve for preventing fuel flow in a reverse direction through feed passage 58. Referring to FIG. 15 and the enlarged cut away view shown in FIG. 16, taken along lines 16'—16', the axial second portion 62 of fuel feed passage 58 opens into a groove 130 formed in the upper surface of nozzle 12. An enlarged recess 132 is provided in the path below which is an axial extension 134 of smaller diameter to form a seat for a valve element 136 (which may also be a ball). The seat and ball form a check valve to prevent reverse flow in the fuel feed line. Fuel is supplied to axial extension 134 through axial branch 138 and a radial branch 140 connected as illustrated in FIG. 16.

Figure 26:
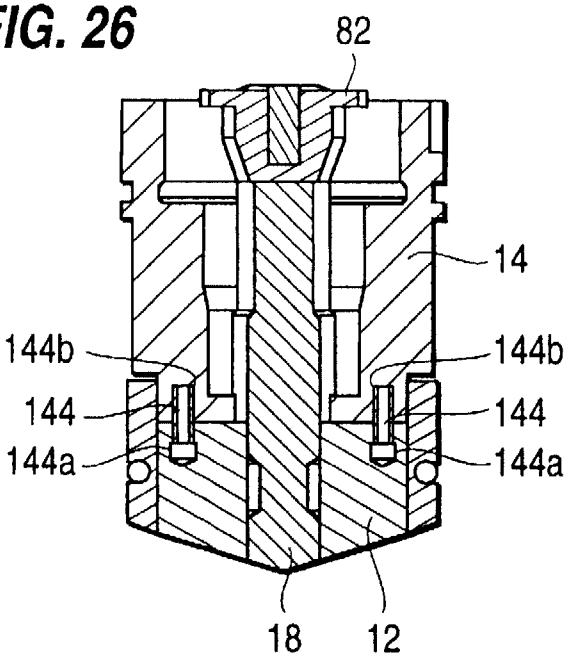
FIG. 26 is a cut away cross sectional view of the spring housing, nozzle, and a retainer for holding the nozzle on the lower end of the spring housing, combined with the lower plunger of the injector plunger assembly, all is taken along lines 26'—26' of FIG. 21.

As will be discussed in greater detail herein below, a first portion 60 of the fuel feed passage 58 contained in spring housing 14 (see FIG. 23) includes a threaded outwardly opening recess 142. First portion 60 of the fuel feed passage 58 is aligned with axial branch 138. To insure that this alignment is maintained, a pair of locating pins 144 (FIG. 26) may be received in corresponding mating holes 144*a* formed in the nozzle and 144*a* formed in the spring housing.

Outwardly opening recess 142, is adapted to receive one of a plurality of selectable threaded plug elements as illustrated, for example by threaded plug 146 in FIG. 24, which may have complementary external threads 146*a*. A restricted feed passage orifice 148 has a diameter predetermined to allow a predetermined volume of fuel to be metered into the metering chamber 66 through fuel feed passage 58 given the operating range of control pressure which may be achieved in the fuel supply (e.g., 5–60 psi). For different engine displacements and desired fuel injecting capability of the unit injector 2, different threaded plugs may be provided. For example, the plug 146' illustrated in FIG. 25 includes a significantly larger constricting orifice 148'. An hexagonal socket 146*b* is provided at the outer end of plugs 146 and 146' of FIGS. 24 and 25, respectively, to receive a torque applying tool for installing and removing the respective plug.

Figure 22:
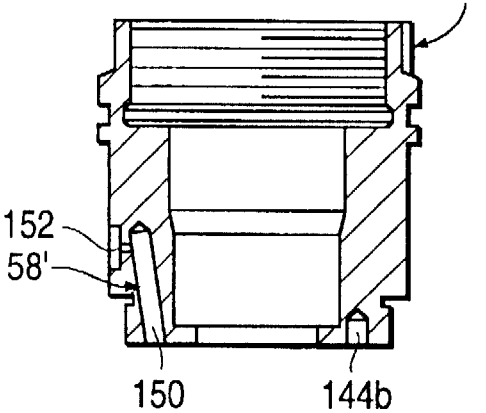
FIG. 22 is a cross sectional view of the spring housing taken along lines 22'—22' of FIG. 21.

In certain engines, the unit injectors are required to have the capacity to inject substantially larger quantities of fuel during each injector cycle, and accordingly, a second fuel feed passage 58' may be provided in the spring housing (see passage 58' in FIG. 22), and in the nozzle (not illustrated). As illustrated in FIG. 22, passage 58' may include an axially oriented first portion 150 and a radially oriented portion 152. The remaining portion of the second fuel feed passage 58' is not illustrated in the drawings but would extend into nozzle 12 and would take the form of the passage portions 62 and 64 shown in FIG. 17.

Figure 23:
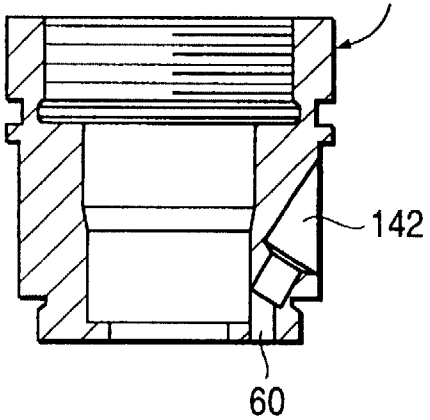
FIG. 23 is a cross sectional view of the spring housing taken along lines 23'—23' of FIG. 21.

Radially oriented portion 152 of the second fuel feed passage 58' may include a fixed size restriction orifice for contributing a first component of predetermined magnitude of fuel metering capacity. The remaining component of fuel metering capacity would be provided by selection of an appropriate threaded plug of the type illustrated in FIGS. 24 and 25 for installation into the complementarily threaded recess 142 of the spring housing as illustrated in FIG. 23.

Operation of the unit injector disclosed herein should now be apparent based on the above detailed description of the preferred embodiment. In particular, when the plunger assembly is in its outermost position as illustrated in FIG. 1, timing fluid will be metered into the variable length timing chamber 52 proportional to the pressure of the timing fluid supplied to the unit injector. Simultaneously, fuel will be metered into metering chamber 66 via the fuel supply passage 58. The quantity of fuel so metered into metering chamber 66 will be proportional to the time of metering and the pressure of the fuel supplied via the fuel supply rail communicating with the unit injector. As cam 38 continues to rotate, the metering phase is terminated by advancement of link 40 and the simultaneous inward movement of outer plunger 20 to close off the timing fluid feed passages and thereby trap a predetermined amount of timing fluid within the variable length timing chamber 52.

Additional advancement of link 40 by cam 38 will cause the inward movement of timing plunger 22 as well as the inner plunger 18 held in contact with 18 at the lower end of the timing plunger by inner spring 78. Such inward movement of the inner plunger 22 will close the radial section 64 of the fuel feed passage thereby also terminating fuel metering into the metering chamber 66. When the inner plunger 18 has been advanced sufficiently to cause the metered fuel in chamber 66 to completely fill the reduced volume thereof, the metered fuel will be forced at very high pressure through injection orifices 68. As the inner plunger 18 reaches its inward most position, the reduced diameter projection 22*a* of the timing plunger 22 will clear the annular groove 114 thus allowing collapse of the hydraulic link within the timing chamber. Once annular groove 114 communicates with the timing chamber, timing fluid is forced through fluid spill passages 92. Spill of timing fluid is resisted by resilient spring like element 94. In particular, element 94 creates a predetermined back pressure sufficient to cause the inner plunger to be held in its forward most position.

Spill of timing fluid continues until cam 38 has advanced link 40 inwardly for its maximum distance whereupon cam 38 permits outward movement of link 40 to cause both the outer plunger 20 and the timing plunger 22 to move outwardly toward the position shown in FIG. 1. As timing plunger 22 nears its outermost position, flange 88 will enter the damping chamber 116 at which point further outward movement caused by inner spring 78 will be reduced in velocity dependent upon the degree of constriction created in the out flow of fuel contained within the damping chamber. The degree of constriction is defined by the complementary shape of radial flange 88 and the inwardly directed flange 118. After the velocity of outward movement is moderated, by displacement of fuel from the damping chamber, the radially oriented stop engaging surface 86 will come into contact with the complementary stop 87 formed as a radial surface in barrel 10 to arrest further outward movement of the timing plunger 22 and retain the timing plunger 22 in a fixed predetermined position during the subsequent metering of both timing fluid and fuel into the unit injector.

This arrangement of the timing plunger has unique and important advantages in open nozzle unit fuel injectors having a variable length hydraulic link for varying the effective length of the injector plunger assembly, particularly wherein the hydraulic link responds, on a cycle by cycle basis to variation in the pressure of timing fluid supplied to the unit injector. In such situations, the injector is sensitive to pressure pulses which may appear in the timing fluid and/or fuel supply and/or drain passages servicing the unit injector. By the disclosed arrangement, sensitivity to such pressure pulses and various pressure changes, are greatly reduced.

This invention is in no way limited to the specific details of the embodiments disclosed above but is intended to include a broad range of equivalent structures adapted to provide in varying degree one or more of the benefits, advantages and improvements of the subject invention.

INDUSTRIAL APPLICABILITY

The subject unit injector has utility in diesel engines particularly diesel engines used in over-the-road vehicle applications. In addition, the unit injector may be used in diesel engines suitable for a fixed site application, such as generator set, and/or off road vehicular application, and/or marine applications.

We claim:

1. An open nozzle fuel injector for variably timing the injection of fuel into the combustion chamber of an internal combustion engine in response to a control signal, comprising an injector body containing an internal bore and at least one open injection orifice adapted to fluidically connect said internal bore with the combustion chamber; and a variable length plunger assembly mounted for reciprocal movement within said internal bore during the successive injection cycles for causing fuel within said internal bore to be injected into the combustion chamber through said open injection orifice as said plunger assembly is advanced, said plunger assembly including an outer plunger, and a timing means for forming a variable length hydraulic link in response to a control signal to allow the effective length of said plunger assembly to be varied on a cycle by cycle basis, said timing means including a timing plunger, and timing plunger stop means for positively arresting retraction of said timing plunger at a predetermining location while the length of said hydraulic link is being set for the next injection cycle in response to the control signal;

whereby the effective length of the hydraulic link can be reliably and predictably set on a cycle by cycle basis in response to the control signal.

2. The fuel injector as defined in claim 1, wherein said timing plunger includes a radially oriented stop engaging surface and said injector body includes a stop positioned to intercept said stop engaging surface to arrest retraction of said timing plunger at said predetermined location.

3. The fuel injector as defined in claim 2, wherein said plunger stop means includes damping means for absorbing momentum of said timing plunger as said timing plunger approaches said predetermined location.

4. The fuel injector as defined in claim 3, wherein said plunger includes a radially outwardly directed flange upon which is formed said radially oriented stop engaging surface and wherein said damping means includes a damping chamber into which said radially outwardly directed flange is received as said timing plunger approaches said predetermined location.

5. The fuel injector as defined in claim 4, wherein said damping chamber is normally filled with fuel which is displaced by said radially outwardly directed flange as said timing plunger nears said predetermined location, said damping chamber including a radially inwardly directed flange positioned and shaped to form a fluid flow constricting gap with said radially outwardly directed flange as said radially outwardly directed flange enters said damping chamber.

6. The fuel injector as defined in claim 1, wherein a timing chamber is formed in said bore between said outer plunger and said timing plunger and further wherein said timing means includes at least one timing fluid feed passage contained in said injector body, said timing fluid feed passage communicating with said collapsible timing chamber for metering a controlled amount of timing fluid into said collapsible timing chamber during each successive injector cycle when said timing plunger and said outer plunger are retracted.

7. The fuel injector as defined in claim 6, wherein the control signal for varying timing during successive cycles is a variable pressure timing fluid and wherein said timing fluid feed passage includes a constricting orifice to cause the amount of timing fluid metered into said collapsible timing chamber to vary during each successive cycle dependent on the pressure of the timing fluid.

8. The fuel injector as defined in claim 7, wherein said timing means includes a plurality of timing fluid feed passages contained in said body, said timing fluid passages opening into said bore at circumferentially spaced equal angular positions around said bore and opening into said bore at an axial locations that cause said openings to be normally blocked when said outer plunger is advanced and to be uncovered when said outer plunger is adjacent its fully retracted position, each of said timing fluid feed passages including a constricting orifice.

9. The fuel injector as defined in claim 8, wherein said timing plunger includes a radially oriented stop engaging surface and said injector body includes a stop positioned to intercept said stop engaging surface to arrest retraction of said timing plunger at said predetermined location.

10. The fuel injector as defined in claim 7, wherein said injector body contains a timing fluid spill passage communicating with said collapsible timing chamber, said timing fluid spill passage being located to communicate with said collapsible timing chamber when said timing plunger nears its fully advanced position to allow the timing fluid metered into said collapsible timing chamber to be expelled thereby collapsing said hydraulic link between said outer plunger and said timing plunger during each successive cycle.

11. The fuel injector as defined in claim 10, wherein the flow of timing fluid from said timing chamber is restricted to create a hold down force on said timing plunger.

12. The fuel injector as defined in claim 11, wherein said timing fluid spill passage communicates with the exterior of said injector body through a spill port, and said timing means includes a resilient element covering said spill port biased to form the restriction to flow of said timing fluid out of said collapsible timing chamber.

13. The fuel injector as defined in claim 6, wherein said variable length plunger assembly further includes an inner plunger for forming a fuel metering chamber at the inner end of said bore when said variable length plunger assembly is retracted and for causing fuel metered into said fuel metering chamber to be injected into the combustion chamber through said open injection orifice as said plunger assembly is advanced.

14. The fuel injector as defined in claim 13, wherein said injector body contains a fuel feed passage communicating with a source of fuel at a selectively variable pressure and with said metering chamber when said inner plunger is adjacent its retracted position, said fuel feed passage including a metering orifice for constricting the flow of fuel into said metering chamber whereby the amount of fuel that is metered into said metering chamber during each successive cycle is dependent upon the pressure of the fuel supplied to said injector body.

15. The fuel injector as defined in claim 14, further including an inner return spring located within said bore for continuously biasing said inner plunger toward its fully retracted position.

16. The fuel injector as defined in claim 15. wherein said injector body includes a barrel containing an outer portion of said bore within which said outer plunger and said timing plunger are mounted for reciprocal movement, a spring housing threadedly connected to the inner end of said barrel and containing therein a spring chamber for receiving said inner return spring, a nozzle containing an inner portion of said bore within which said inner plunger is mounted for reciprocal movement, said nozzle containing said injection orifice at its innermost end, and a nozzle retainer for telescopingly receiving said nozzle and for threadedly engaging said spring housing to hold the outer end of said nozzle in contact with said spring housing.

17. The fuel injector as defined in claim 16, wherein said barrel contains a damping chamber at its inner end and wherein said timing plunger includes a radial flange formed on said timing plunger for entering said damping chamber as said timing plunger approaches its fully retracted position to create a damping means for absorbing momentum of said timing plunger when said damping chamber is filled with liquid.

18. The fuel injector as defined in claim 16, wherein said spring housing includes a radially inwardly directed spring support surface at the inner end for directly contacting and supporting the inner end of said inner return spring.

19. The fuel injector as defined in claim 18, wherein said spring housing contains a first portion of said fuel feed passage and said nozzle contains a second portion of said fuel feed passage in fluid communication with said one portion, and further including at least one pin for holding said spring housing and said nozzle in a fixed predetermined rotational position to insure that said first and second portions of said fuel feed passage remain in fluid communication.

20. The fuel injector as defined in claim 19, wherein said second portion of said fuel feed passage includes a recess for receiving a check valve element for preventing reverse flow of fuel or combustion gas from said metering chamber into said first portion of said fuel feed passage.

21. The fuel injector as defined in claim 20, wherein said first portion of said fuel feed passage includes a threaded recess for receiving a threaded plug containing said metering orifice.

22. The fuel injector as defined in claim 16, further including a spring guide pressed on the outer end of said inner plunger and arranged to engage the outer end of said inner return spring to bias the outer end of said inner plunger toward the inner end of said timing plunger, said spring guide extending a sufficient distance in the outer direction to contact the inner end of said timing plunger.

23. The fuel injector as defined in claim 1, further including an outer spring for biasing said outer plunger toward its fully retracted position, an outer spring housing assembly mounted on said injector body, the inner end of said outer spring contacting said outer spring housing, and still further including a coupling connected at one end to said outer plunger and contacting at the other end the outer end of said outer spring.

24. The fuel injector as defined in claim 23, wherein said outer spring housing includes a coupling stop for defining the fully retracted position of said outer plunger, said outer spring housing including means for adjustably changing the fully retracted position of said outer plunger.

25. A cam operated open nozzle fuel injector for hydraulically varying the timing of fuel injection into the combustion chamber of an internal combustion engine during successive injection cycles, comprising an injector body containing an internal bore and at least one open injection orifice adapted to fluidically connect said internal bore with the combustion chamber;

a variable length plunger assembly mounted for reciprocal movement within said internal bore during the successive injection cycles, said plunger assembly including an inner plunger for forming a fuel metering chamber at the inner end of said bore when said variable length plunger assembly is retracted and for causing fuel metered into said fuel metering chamber to be injected into the combustion chamber through said open injection orifice as said plunger assembly is advanced, an outer plunger reciprocated in response to rotation of a cam, and a timing plunger located intermediate said injection plunger and said outer plunger to form a collapsible timing chamber with said outer plunger into which a controlled amount of timing fluid may be metered and trapped during each successive injection cycle to form a hydraulic link to vary the effective length of said plunger assembly during each successive cycle; and a plunger stop located to engage said timing plunger to arrest positively movement of said timing plunger at a predetermined location while the length of said hydraulic link is being set for the next injection cycle.

26. The fuel injector as defined in claim 25, wherein said timing plunger includes a radially oriented stop engaging surface and wherein said stop is positioned to engage said stop engaging surface to arrest retraction of said timing plunger at said predetermined location.

27. The fuel injector as defined in claim 26, wherein said plunger stop includes damping means for absorbing momentum of said timing plunger prior to reaching said predetermined location.

28. The fuel injector as defined in claim 27, wherein said timing plunger includes a radially outwardly directed flange upon which is formed said radially oriented stop engaging surface and wherein said damping means includes a damping chamber into which said radially outwardly directed flange is received as said timing plunger approaches said predetermined location.

29. The fuel injector as defined in claim 28, wherein said damping chamber is normally filled with fuel which is displaced by said radially outwardly directed flange as said timing plunger nears said predetermined location, said damping chamber including a radially inwardly directed flange positioned and shaped to form a fluid flow constricting gap with said radially outwardly directed flange as said radially outwardly directed flange enters said damping chamber.

30. The fuel injector as defined in claim 25, wherein a timing chamber is formed in said bore between said outer plunger and said timing plunger and further wherein said injector body contains at least one timing fluid feed passage, said timing fluid feed passage communicating with said collapsible timing chamber for metering a controlled amount of timing fluid into said collapsible timing chamber in response to a control signal during each successive injector cycle when said timing plunger and said outer plunger are retracted.

31. The fuel injector as defined in claim 30, wherein the control signal for varying timing during successive cycles is a variable pressure timing fluid and wherein said timing fluid feed passage includes a constricting orifice to cause the amount of timing fluid metered into said collapsible timing chamber to vary during each successive cycle dependent on the pressure of the timing fluid.

32. The fuel injector as defined in claim 31, wherein said injector body contains a plurality of timing fluid feed passages, said timing fluid passages opening into said bore at circumferentially spaced equal angular positions around said bore and opening into said bore at an axial locations that cause said openings to be normally blocked when said outer plunger is advanced and to be uncovered when said outer plunger is adjacent its fully retracted position, each of said timing fluid feed passages including a constricting orifice for causing the amount of timing fluid metered into said timing chamber to be a function of the pressure of the timing fluid supplied to said timing fluid passages.

33. The fuel injector as defined in claim 32, wherein said timing plunger includes a radially oriented stop engaging surface and said injector body includes a stop positioned to intercept said stop engaging surface to arrest retraction of said timing plunger at said predetermined location.

34. The fuel injector as defined in claim 33, wherein said injector body contains a timing fluid spill passage communicating with said collapsible timing chamber, said timing fluid spill passage being located to communicate with said collapsible timing chamber when said timing plunger nears its fully advanced position to allow the timing fluid metered into said collapsible timing chamber to be expelled thereby collapsing said hydraulic link between said outer plunger and said timing plunger during each successive cycle.

35. The fuel injector as defined in claim 34, wherein the flow of timing fluid from said timing chamber is restricted to create a hold down force on said timing plunger.

36. The fuel injector as defined in claim 35, wherein said timing fluid spill passage communicates with the exterior of said injector body through a spill port, and further including a resilient element covering said spill port biased to form the restriction to flow of said timing fluid out of said collapsible timing chamber.

37. The fuel injector as defined in claim 30, wherein said variable length plunger assembly further includes an inner plunger for forming a fuel metering chamber at the inner end of said bore when said variable length plunger assembly is retracted and for causing fuel metered into said fuel metering chamber to be injected into the combustion chamber through said open injection orifice as said plunger assembly is advanced.

38. The fuel injector as defined in claim 37, wherein said injector body contains a fuel feed passage communicating with a source of fuel at a selectively variable pressure and with said metering chamber when said inner plunger is adjacent its retracted position, said fuel feed passage including a metering orifice for constricting the flow of fuel into said metering chamber whereby the amount of fuel that is metered into said metering chamber during each successive cycle is dependent upon the pressure of the fuel supplied to said injector body.

39. The fuel injector as defined in claim 38, further including an inner return spring located within said bore for continuously biasing said inner plunger toward its fully retracted position.

40. The fuel injector as defined in claim 39, wherein said injector body includes a barrel containing an outer portion of said bore within which said outer plunger and said timing plunger are mounted for reciprocal movement, a spring housing threadedly connected to the inner end of said barrel and containing therein a spring chamber for receiving said inner return spring, a nozzle containing an inner portion of said bore within which said inner plunger is mounted for reciprocal movement, said nozzle containing said injection orifice at its innermost end, and a nozzle retainer for telescopingly receiving said nozzle and for threadedly engaging said spring housing to hold the outer end of said nozzle in contact with said spring housing.

41. The fuel injector as defined in claim 40, wherein said barrel contains a damping chamber at its inner end and wherein said timing plunger includes a radial flange formed on said timing plunger for entering said damping chamber as said timing plunger approaches its fully retracted position to create a damping means for absorbing momentum of said timing plunger when said damping chamber is filled with liquid.

42. The fuel injector as defined in claim 41, wherein said spring housing includes a radially inwardly directed spring support surface at the inner end for directly contacting and supporting the inner end of said inner return spring.

43. A The fuel injector as defined in claim 42, wherein said spring housing contains a first portion of said fuel feed passage and said nozzle contains a second portion of said fuel feed passage in fluid communication with said one portion, and further including at least one pin for holding said spring housing and said nozzle in a fixed predetermined rotational position to insure that said first and second portions of said fuel feed passage remain in fluid communication.

44. The fuel injector as defined in claim 43, wherein said second portion of said fuel feed passage includes a recess for receiving a check valve element for preventing reverse flow of fuel or combustion gas from said metering chamber into said first portion of said fuel feed passage.

45. The fuel injector as defined in claim 44, wherein said first portion of said fuel feed passage includes a threaded recess for receiving a threaded plug containing said metering orifice.

46. The fuel injector as defined in claim 45, further including a spring guide mounted on the outer end of said inner plunger and arranged to engage the outer end of said inner return spring to cause the outer end of said inner plunger toward the inner end of said timing plunger, said spring guide extending a sufficient distance in the outer direction to contact the inner end of said timing plunger.

47. The fuel injector as defined in claim 46, further including an outer spring for biasing said outer plunger toward its fully retracted position, an outer spring housing assembly mounted on said injector body, the inner end of said outer spring contacting said outer spring housing, and still further including a coupling connected at one and to said outer plunger and contacting at the other end the outer end of said outer spring.

48. The fuel injector as defined in claim 47, wherein said outer spring housing includes a coupling stop for defining the fully retracted position of said outer plunger, said outer spring housing including means for adjustably changing the fully retracted position of said outer plunger.

49. The fuel injector as defined in claim 48, wherein the injector is driven by a cam operated drive train including a link and wherein said coupling includes an outwardly opening recess for receiving the link, a radially directed ledge forming at least partially the bottom wall of said recess and defining an opening for receiving the outer end of said outer plunger in an axial position causing its outermost end to align flush with said ledge to form the inner floor of said recess, and further including a thrust plate positioned within said recess in contact on its outer side with the link and on its inner side with said ledge and the outermost end of said outer plunger to cause the inwardly directed force imparted by the link to said thrust plate to be imparted directly both to said outer plunger and to said ledge of said coupling whereby any tendency of said coupling to move axially relative to said outer plunger is avoided.

* * * * *